US008879764B2

(12) United States Patent
Andersen

(10) Patent No.: US 8,879,764 B2
(45) Date of Patent: Nov. 4, 2014

(54) CONFIGURABLE FM RECEIVER FOR HEARING DEVICE

(71) Applicant: Oticon A/S, Smørum (DK)

(72) Inventor: Marinus Andersen, Smørum (DK)

(73) Assignee: Oticon A/S, Smorum (DK)

( * ) Notice: Subject to any disclaimer, the term of this patent is extended or adjusted under 35 U.S.C. 154(b) by 29 days.

(21) Appl. No.: 13/712,389

(22) Filed: Dec. 12, 2012

(65) Prior Publication Data

US 2013/0148831 A1 Jun. 13, 2013

Related U.S. Application Data

(60) Provisional application No. 61/569,807, filed on Dec. 13, 2011.

(30) Foreign Application Priority Data

Dec. 13, 2011 (EP) ..... 11193269

(51) Int. Cl.
*H04R 25/00* (2006.01)

(52) U.S. Cl.
USPC ..... 381/315; 381/312

(58) Field of Classification Search
USPC ..... 381/312, 314–316, 331
See application file for complete search history.

(56) References Cited

U.S. PATENT DOCUMENTS

| | | | | |
|---|---|---|---|---|
| 8,077,892 | B2 * | 12/2011 | Dijkstra et al. | 381/315 |
| 2002/0054684 | A1 | 5/2002 | Menzl | |
| 2007/0147641 | A1 | 6/2007 | Platz | |

FOREIGN PATENT DOCUMENTS

| | | | |
|---|---|---|---|
| AU | 2000269773 | B2 | 3/2002 |
| WO | WO 97/21325 | A1 | 6/1997 |
| WO | WO 98/44761 | A2 | 10/1998 |
| WO | WO 99/13699 | A2 | 3/1999 |
| WO | WO 02/23948 | A1 | 3/2002 |
| WO | WO 02/094370 | A1 | 11/2002 |
| WO | WO 2007/045081 | A1 | 4/2007 |
| WO | WO 2007/144010 | A1 | 12/2007 |
| WO | WO 2011/104585 | A1 | 9/2011 |

* cited by examiner

*Primary Examiner* — Suhan Ni
(74) *Attorney, Agent, or Firm* — Birch, Stewart, Kolasch & Birch, LLP

(57) ABSTRACT

Hearing system comprising a hearing device and an FM receiver, the FM receiver being adapted to be operationally connected to the hearing device and to communicate wirelessly with an FM transmitter on an FM channel, the hearing device comprising memory storing configuration data indicating the FM channel and transferring means for transferring the stored configuration data to the FM receiver, the hearing system further comprising a configurator adapted to configure the FM receiver to use the indicated FM channel for communicating wirelessly with the FM transmitter. The hearing system further comprises a detector adapted to detect whether the FM receiver is operationally connected to the hearing device, and the transferring means further is adapted to transfer the stored configuration data to the FM receiver in response to the FM receiver going from not being operationally connected to being operationally connected to the hearing device.

13 Claims, 3 Drawing Sheets

CONFIGURABLE FM RECEIVER FOR HEARING DEVICE

CROSS-REFERENCE TO RELATED APPLICATIONS

This nonprovisional application claims the benefit of U.S. Provisional Application No. 61/569,807 filed on Dec. 13, 2011 and to Patent Application No. 11193269.5 filed on Dec. 13, 2011 in Europe. The entire contents of all of the above applications is hereby incorporated by reference.

TECHNICAL FIELD

The present invention relates to the field of hearing systems comprising hearing devices, such as hearing aids, and FM receivers to be used with the hearing devices. The present invention furthermore relates to a method of configuring an FM receiver.

BACKGROUND ART

A hearing system may comprise a hearing device and an FM receiver, which is an auxiliary device designed to be operationally connected to a hearing device in order to enable the hearing device to receive audio signals via FM (i.e. frequency modulated) radio signals. An FM receiver may provide an electric audio signal to the hearing device via a connector, which may also be used for mechanically securing the FM receiver to the hearing device. Alternatively, an FM receiver may provide a wireless audio signal to the hearing device, e.g. via an inductive connection or via a Bluetooth connection.

FM receivers are typically used in classroom systems where a teacher wears an FM transmitter having a microphone and one or more pupils wear an FM receiver attached to their hearing devices. To provide for all pupils to be able to listen equally well to the teacher speaking into the microphone, a respective hearing device FM receiver has to be configured to use the correct FM channel for communicating with the FM transmitter using e.g. a handheld configuring device or a personal computer (PC).

DISCLOSURE OF INVENTION

It is an object of the present invention to provide an alternative arrangement and method for configuring an FM receiver.

According to a first aspect of the current invention the object is achieved by a method for configuring a slave FM receiver adapted to be operationally connected to a hearing device and to communicate wirelessly with an FM transmitter on a predetermined FM channel, the method comprising:

- storing configuration data indicating the predetermined FM channel in the hearing device;
- detecting whether the slave FM receiver is operationally connected to the hearing device;
- transferring the stored configuration data to the slave FM receiver in response to detecting the slave FM receiver going from not being operationally connected to being operationally connected to the hearing device; and
- configuring the slave FM receiver to use the FM channel indicated in the transferred configuration data for communicating wirelessly with the FM transmitter.

The present invention recognizes that prior art methods of configuring an FM receiver in a class-room system unfavourably demand the configuration data to be stored in the FM receiver and require the repeated use of handheld configuring devices or PCs. If—for example—an FM receiver is lost or broken, so is the configuration data stored therein, resulting in having to manually configure a replacement FM receiver. The present invention also recognizes that, according to prior art, a school owned FM receiver must be given to the correct pupil or even be reconfigured every morning. Furthermore a pupil wearing hearing devices on both ears has to ensure that an FM receiver configured to provide a left-channel audio signal to the left-ear hearing device is attached to the same, the same being true for an FM receiver configured to provide a right-channel audio signal to the right-ear hearing device. These drawbacks prevalent in the prior art and recognized by the invention cause a significant reduction of school time actually spent with learning.

According to the present invention, therefore, it is suggested to store the configuration data in the user's hearing device and to transfer the configuration data to the FM receiver when the FM receiver is being operationally connected to the hearing device. Thus, if an FM receiver is lost or broken, the configuration data are automatically transferred to a replacement FM receiver when it is first connected to the hearing device. Accordingly, the FM receiver is automatically connected to the FM transmitter on the desired FM channel. In this manner a connection between an FM receiver and an FM transmitter may be established without requiring a user input, which is especially suitable for school systems.

The term "configuring" addresses measures taken to enable an FM receiver to participate in a specific class room system as described above. Further to indicating an FM channel to be used, configuration data may indicate other configuration features relating to an FM receiver, such as e.g.: a name of the FM receiver, a gain of the FM receiver, a left or right channel selection of the FM receiver, a mode switch functionality of the FM receiver, an indicator LED functionality of the FM receiver, a de-emphasis mode of the FM receiver, a signalling functionality of the FM receiver, a disabling/enabling of manual channel change of the FM receiver, a disabling/enabling of channel seek of the FM receiver, and/or a channel set of the FM receiver.

In the following, potential embodiments of the method for configuring an FM receiver according to the first aspect of the invention are described. Additional features explained in the context of different embodiments and/or aspects may be combined with each other to form further embodiments, as long as they are not explicitly described as forming mutually exclusive alternatives to each other.

In a preferred embodiment, to economize electrical resources, the transferring of the configuration data to the FM receiver is performed via the same connection the hearing device uses to receive audio signals from the FM receiver.

To automate the configuring of the FM receiver, the transferring of the configuration data to the FM receiver may be performed when it is detected that the FM receiver is being operatively connected to a hearing device. Such detection may comprise detecting whether the FM receiver is communicatively and/or mechanically connected to the hearing device; the transferring of the configuration data to the FM receiver may thus e.g. be performed upon start-up of the FM receiver or upon initiating communication between the hearing device and the FM receiver. The transferring may optionally require a user approval, e.g. require the user to press an "OK" button or the like.

In a preferred embodiment, a master FM receiver transfers the configuration data indicating the predetermined FM channel to the hearing device prior to the storing of the configuration data in the hearing device. In this manner configuration data may be initially transferred to a hearing device without having access to the hearing device with a separate configuring device or PC.

According to a second aspect of the current invention the object is achieved by a hearing system comprising a hearing device and an FM receiver, the FM receiver being adapted to be operationally connected to the hearing device and to communicate wirelessly with an FM transmitter on a predetermined FM channel, the hearing device comprising a memory for storing configuration data indicating the predetermined FM channel and transferring means for transferring the stored configuration data to the FM receiver, the hearing system further comprising a configurator adapted to configure the FM receiver to use the FM channel indicated in the transferred configuration data for communicating wirelessly with the FM transmitter, characterised in that the hearing system further comprises a detector adapted to detect whether the FM receiver is operationally connected to the hearing device, and in that the transferring means further is adapted to transfer the stored configuration data to the FM receiver in response to the FM receiver going from not being operationally connected to being operationally connected to the hearing device.

In a preferred embodiment, to limit the complexity of the FM receiver's circuitry, the transferring means is further adapted to transfer the stored configuration data using the same connection the FM receiver uses to send audio signals to the hearing device.

In any aspect, the configuration data may comprise further configuration features relating to an FM receiver. If, for instance, configuring the FM receiver includes selecting an ear assigned to the receiver, e.g. in order to correctly assign left-channel and right-channel in a stereo FM system to the respective ears, including this information in the configuration data advantageously frees a user from having to keep track of FM receivers configured to a specific ear. Other such configuration features may enable an FM receiver to be optimized to a specific hearing device, which is especially advantageous for school systems, as it allows a pool of FM receivers to be easily shared.

In the present context, a "hearing device" refers to a device, such as e.g. a hearing aid or an active ear-protection device, which is adapted to improve or augment the hearing capability of an individual by receiving acoustic signals from the individual's surroundings, modifying the acoustic signals electronically and providing audible signals to at least one of the individual's ears. Such audible signals may e.g. be provided in the form of acoustic signals radiated into the individual's outer ears, acoustic signals transferred as mechanical vibrations to the individual's inner ears through the bone structure of the individual's head and/or electric signals transferred directly or indirectly to the cochlear nerve of the individual. The hearing device may be configured to be worn in any known way, e.g. as a unit arranged behind the ear with a tube leading radiated acoustic signals into the ear canal or with a speaker arranged close to or in the ear canal, as a unit entirely or partly arranged in the pinna and/or in the ear canal, as a unit attached to a fixture implanted into the skull bone, etc. More generally, a hearing device comprises an input transducer for receiving an acoustic signal from an individual's surroundings and providing a corresponding electric input signal, a signal processing circuit for processing the electric input signal and an output transducer for providing an audible signal to the individual in dependence on the processed signal.

A "hearing system" refers to a system comprising one or two hearing devices, and a "binaural hearing system" refers to a system comprising one or two hearing devices and being adapted to provide audible signals to both of the individual's ears. Hearing systems or binaural hearing systems may further comprise "auxiliary devices", which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability or augmenting a normal-hearing person's hearing capability.

MODE(S) FOR CARRYING OUT THE INVENTION

Figure 1:
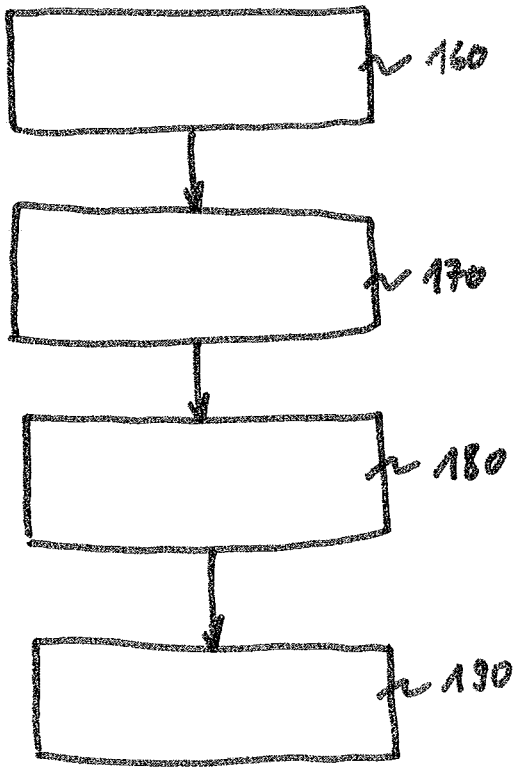
FIG. 1 schematically depicts, by means of a flow chart, an embodiment of a method according to the first aspect of the invention, FIG. 2 schematically depicts a hearing system according to a first embodiment of the second aspect of the invention, and FIG. 3 schematically depicts a hearing system according to a second embodiment of the second aspect of the invention.

In a first step 160 of a method for configuring an FM receiver in FIG. 1 configuration data indicating a predetermined FM channel are stored in a memory of a hearing device.

In a second step 170 it is detected whether the FM receiver is operationally connected to the hearing device, preferably by a device detector comprised by the FM receiver and/or an accessory detector comprised by the hearing device.

In a third step 180 the stored configuration data is transferred to the FM receiver, preferably via the same connection the hearing device uses to receive audio signals from the FM receiver. The transfer takes place in response to the slave FM receiver going from not being operationally connected to being operationally connected to the hearing device.

In a fourth step 190 the FM receiver is configured, preferably by a configurator, to use the FM channel indicated in the transferred configuration data for communicating wirelessly with the FM transmitter.

Preferably, a PC, a handheld configuring device, e.g. a smart phone, or another suitable configuring device (not shown) initially transfers configuration data indicating the predetermined FM channel to the hearing device prior to the storing 160 of the configuration data in the hearing device. The configuration data may thus be initially transferred to the hearing device at a time when the FM receiver is not operationally connected to the hearing device. When the FM receiver is subsequently operationally connected to the hearing device, the FM receiver is automatically configured to use the predetermined FM channel for communicating with the FM transmitter. In the case that the FM receiver is lost or defect, a new one with the same functionality (with respect to the present invention) may be connected and thus also be automatically configured to use the predetermined FM channel. The configuring device may be adapted to be connected to the hearing device in the same way as the FM receiver, however, instead of receiving configuration data from the hearing device, it is adapted to transfer configuration data to the hearing device. The selection of the FM channel to be indicated in the configuration data may be made e.g. by means of manually operable switches on the configuring device or by other well known means.

The configuring device may further function as an FM receiver for the purpose of communicating wirelessly with the FM transmitter and providing audio signals to the hearing device. Such a configuring device is hereafter denoted a "master" FM receiver.

A master FM receiver set to a predetermined FM channel may be used to initially transfer configuration data to several hearing devices. In this way, multiple master FM receivers set to different FM channels may be used to indirectly configure multiple "slave", i.e. non-master, FM receivers for different class room systems.

Alternatively, an FM receiver may initially act as master FM receiver and subsequently, i.e. after initially transferring configuration data to a hearing device, the FM receiver may operate as slave FM receiver, i.e. allow configuration data from the hearing device to overwrite or override the selection of the FM channel. In this way, an FM receiver may be used to program a single hearing device to subsequently configure newly connected FM receivers to the same FM channel, and the FM receiver used to program the hearing device may subsequently be used for connecting the programmed hearing device—or any other hearing device—with an FM transmitter.

Preferably, a configuring device transfers the configuration data indicating the predetermined FM channel to the master FM receiver prior to the transferring 160 of the configuration data to the hearing device. The configuration data may thus be initially transferred to the master FM receiver at a time when the master FM receiver is not operationally connected to the hearing device. An FM receiver may initially operate as a slave FM receiver and, in response to receiving configuration data from the configuring device, switch to a master mode, in which it operates as a master FM receiver. Together with the configuration data, the configuring device may transfer a setting to the FM receiver, indicating whether the FM receiver is to remain in the master mode, or alternatively switch to slave mode after transferring 160 the configuration data to a hearing device.

The configuration data may further indicate: a network name of the FM receiver, a gain of the FM receiver, a left or right channel selection of the FM receiver, a mode switch functionality of the FM receiver, an indicator LED functionality of the FM receiver, a de-emphasis mode of the FM receiver, a signalling functionality of the FM receiver, a disabling/enabling of manual channel change of the FM receiver, a disabling/enabling of channel seek of the FM receiver, and/or an FM channel set of the FM receiver.

Figure 2:
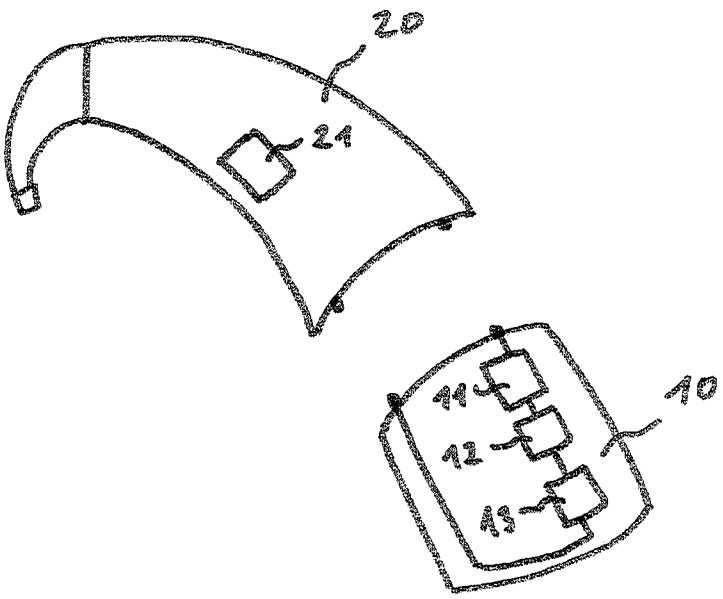

The hearing system in FIG. 2 comprises a hearing device 20 and an FM receiver 10 adapted to be operationally connected to the hearing device 20. The FM receiver 10 comprises and houses a device detector 11, a configurator 12 and a receiving means 13. The hearing device 20 comprises and houses a memory 21 adapted to store configuration data indicating which FM channel is to be used by the FM receiver 10 for wireless communication with an FM transmitter (not shown).

The device detector 11 is adapted to detect whether the FM receiver 10 is operationally connected to the hearing device 20. The detection may e.g. be made by detecting whether the FM receiver 10 is mechanically connected to the hearing device 20, or by detecting whether the FM receiver 10 receives electric power or an electric or electromagnetic signal, such as a wired or wireless communication signal, from the hearing device 20.

The receiving means 13 is adapted to transfer configuration data that is stored within the memory 21 to the configurator 12 in response to the FM receiver 10 going from not being operationally connected to being operationally connected to the hearing device 20. The transition is preferably detected by monitoring an output of the device detector 11. The receiving means 13 may interact directly with the memory 21 or, alternatively, interact with a sending means 23 (see FIG. 3) in the hearing device 20 for executing the transfer.

The configurator 12 is adapted to automatically configure the FM receiver 10 to use the FM channel indicated in the configuration transferred to the configurator 12. The FM receiver 10 may subsequently receive audio signals from the FM transmitter on the indicated FM channel and provide the received audio signals to the hearing device 20 via a wired or wireless connection.

In the depicted embodiment, the receiving means 13 is adapted to transfer the configuration data using the same connection the FM receiver 10 uses to send audio signals to the hearing device 20. To serve that purpose, the receiving means 13 is electrically connected to electric terminals of the FM receiver 10, which are adapted to be connected to corresponding electric terminals of the hearing device 20. The electric terminals may be connected by direct contact or indirectly by means of a cable. Alternatively, the connection between the FM receiver 10 and the hearing device 20 is wireless, and the receiving means 13 comprises a corresponding wireless receiver or wireless transceiver, while the sending means 23 (see FIG. 3) in the hearing device 20 comprises a corresponding wireless transmitter or wireless transceiver.

Figure 3:
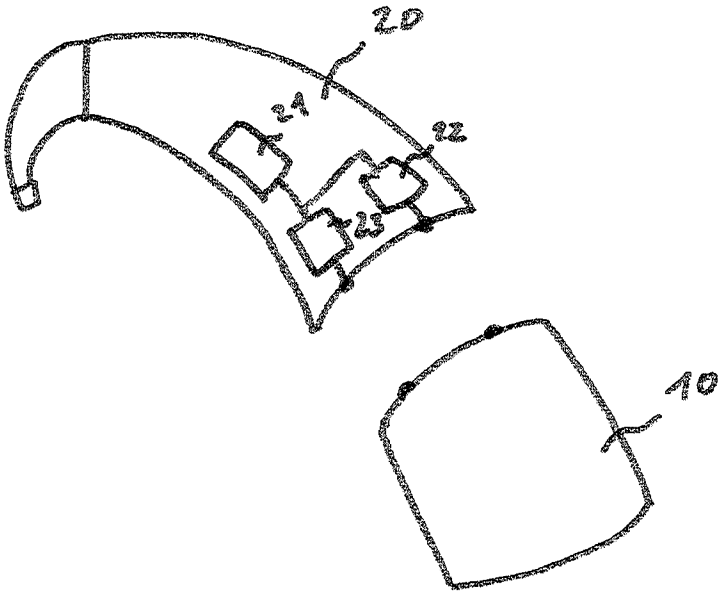

The hearing system in FIG. 3 comprises a hearing device 20 and an FM receiver 10 adapted to be operationally connected to the hearing device 20. The hearing device 20 comprises and houses a memory 21 adapted to store configuration data indicating which FM channel is to be used by the FM receiver 10 for wireless communication with an FM transmitter (not shown).

The accessory detector 22 is adapted to detect whether the FM receiver 10 is operationally connected to the hearing device 20. The detection may e.g. be made by detecting whether the FM receiver 10 is mechanically connected to the hearing device 20, or by detecting whether the hearing device 20 receives electric power or an electric or electromagnetic signal, such as a wired or wireless communication signal, from the FM receiver 10.

The sending means 23 is adapted to transfer the configuration data stored in the memory 21 to the FM receiver 10 in response to detecting that the FM receiver 10 is going from not being operationally connected to being operationally connected to the hearing device 20. The transition is preferably detected by monitoring an output signal of the accessory detector 22.

The sending means 23 may interact directly with a configurator 12 (see FIG. 2) in the FM receiver 10 or, alternatively, interact with a receiving means 13 (see FIG. 2) in the FM receiver 10 for executing the transfer.

The configurator 12 is adapted to automatically configure the FM receiver 10 to use the FM channel indicated in the configuration transferred to the configurator 12. The FM receiver 10 may subsequently receive audio signals from the FM transmitter on the indicated FM channel and provide the received audio signals to the hearing device 20 via a wired or wireless connection.

In the depicted embodiment, the sending means 23 is adapted to transfer the configuration data using the same connection the FM receiver 10 uses to send audio signals to the hearing device 20. To serve that purpose, the sending means 23 is electrically connected to electric terminals of the hearing device 20, which are adapted to be connected to corresponding electric terminals of the FM receiver 10. The electric terminals may be connected by direct contact or indirectly by means of a cable. Alternatively, the connection between the FM receiver 10 and the hearing device 20 is wireless, and the sending means 23 comprises a corresponding wireless transmitter or wireless transceiver, while the receiving means 13 (see FIG. 2) in the FM receiver 10 comprises a corresponding wireless receiver or wireless transceiver.

In any embodiment, to meet desired requirements, the accessory detector 21 and/or the device detector 11 may be located in the FM receiver 10 and/or in the hearing device 20. If for example the FM receiver 10 is designated to be a "passive" device, the accessory detector 21 and the device detector 11 may be located in the hearing device 20. Additionally or optionally, the configurator 12 may be located in the hearing device 20. This further reduces the complexity of the FM receiver 10.

In the context of the present invention, the term "transferring configuration data" is to be interpreted as providing the information indicated by the configuration data to the respective recipient. Thus, the configuration data need not be transmitted in the way they are stored in the memory 21 of the hearing device 20, but may be altered in any known way, as long as the information is not lost.

The teachings of the present invention may also be used to configure other types of wireless communication accessories for hearing devices. For instance, the FM receiver may be replaced with a receiver using another wireless technology to connect with a corresponding transmitter, e.g. Bluetooth, WiFi, digital packet radio or other types of radio frequency communication. In this case, all of the above applies mutatis mutandis, except that the configuration data transferred between the hearing device and the receiver does not indicate an FM channel, but other information enabling the receiver to connect to a specific transmitter, and that the receiver connects with that specific transmitter using its dedicated radio frequency communication technology. The configuration data may e.g. indicate a Bluetooth device name, a Bluetooth pairing code, a WiFi access point SSID, a WiFi access point pass phrase and/or any other suitable device or network identification and/or authentication information.

The invention claimed is:

1. Method for configuring a physically detachable slave FM receiver adapted to be operationally connected and external to a hearing device and to communicate wirelessly with an FM transmitter on a predetermined FM channel, the method comprising:

storing configuration data indicating the predetermined FM channel in the hearing device;

detecting whether the physically detachable slave FM receiver is operationally connected to the hearing device, external to the hearing device;

transferring the stored configuration data to the slave FM receiver in response to the slave FM receiver going from not being operationally connected to being operationally connected to the hearing device; and configuring the slave FM receiver to use the FM channel indicated in the transferred configuration data for communicating wirelessly with the FM transmitter.

2. Method according to claim 1, wherein the transferring of the stored configuration data to the slave FM receiver is performed via the same connection the hearing device uses to receive audio signals from the slave FM receiver.

3. Method according to claim 1 or 2, wherein a PC or a handheld configuring device transfers the configuration data indicating the predetermined FM channel to the hearing device prior to the storing of the configuration data in the hearing device.

4. Method according to claim 1 or 2, wherein a master FM receiver transfers the configuration data indicating the predetermined FM channel to the hearing device prior to the storing of the configuration data in the hearing device.

5. Method according to claim 4, wherein the master FM receiver subsequently operates as the slave FM receiver.

6. Method according to claim 4, wherein a PC or a handheld configuring device transfers the configuration data indicating the predetermined FM channel to the master FM receiver prior to the transferring of the configuration data to the hearing device.

7. Method according to claim 1, wherein the configuration data further indicates:

a network name of the FM receiver, a gain of the FM receiver, a left or right channel selection of the FM receiver, a mode switch functionality of the FM receiver, an indicator LED functionality of the FM receiver, a de-emphasis mode of the FM receiver, a signalling functionality of the FM receiver, a disabling/enabling of manual channel change of the FM receiver, a disabling/enabling of channel seek of the FM receiver, and/or an FM channel set of the FM receiver.

8. A hearing system comprising:

a hearing device; and an FM receiver which is physically detachable and external from the hearing device, the FM receiver being adapted to be operationally connected to the hearing device and to communicate wirelessly with an FM transmitter on a predetermined FM channel, wherein the hearing device includes a memory for storing configuration data indicating the predetermined FM channel, and transferring unit configured to transfer the stored configuration data to the FM receiver, the hearing system further comprising a configurator adapted to configure the FM receiver to use the FM channel indicated in the transferred configuration data for communicating wirelessly with the FM transmitter, the hearing system further comprises a detector adapted to detect whether the physically detachable and external FM receiver is operationally connected to the hearing device, and the transferring unit further is adapted to transfer the stored configuration data to the FM receiver in response to the FM receiver going from not being operationally connected to being operationally connected to the hearing device.

9. The hearing system according to claim 8, wherein the transferring unit further is adapted to transfer the stored configuration data using the same connection the FM receiver uses to send audio signals to the hearing device.

10. The hearing system according to claim 8 or 9, further comprising:

a PC or a handheld configuring device adapted to transfer the configuration data indicating the predetermined FM channel to the hearing device prior to the storing of the configuration data in the hearing device.

11. Hearing system according to claim 8 or 9, wherein the FM receiver further is adapted to temporarily operate in a master mode, in which it transfers the configuration data indicating the predetermined FM channel to the hearing device prior to the storing of the configuration data in the hearing device.

12. The hearing system according to claim 11, further comprising:

a PC or a handheld configuring device adapted to transfer the configuration data indicating the predetermined FM channel to the FM receiver operating in the master mode prior to the transferring of the configuration data to the hearing device.

13. Hearing system according to claim 8, wherein the configuration data further indicates:

a network name of the FM receiver, a gain of the FM receiver, a left or right channel selection of the FM receiver, a mode switch functionality of the FM receiver, an indicator LED functionality of the FM receiver, a de-emphasis mode of the FM receiver, a signalling functionality of the FM receiver, a disabling/enabling of manual channel change of the FM receiver, a disabling/enabling of channel seek of the FM receiver, and/or an FM channel set of the FM receiver.

* * * * *